US009545124B1

(12) United States Patent
Thompson

(10) Patent No.: US 9,545,124 B1
(45) Date of Patent: Jan. 17, 2017

(54) POST SURGERY BRASSIERE

(71) Applicant: Elizabeth Chabner Thompson, Scarsdale, NY (US)

(72) Inventor: Elizabeth Chabner Thompson, Scarsdale, NY (US)

( * ) Notice: Subject to any disclaimer, the term of this patent is extended or adjusted under 35 U.S.C. 154(b) by 16 days.

(21) Appl. No.: 14/710,953

(22) Filed: May 13, 2015

Related U.S. Application Data

(60) Provisional application No. 62/140,827, filed on Mar. 31, 2015.

(51) Int. Cl.
*A41C 3/02* (2006.01)
*A41C 3/00* (2006.01)

(52) U.S. Cl.
CPC ..... *A41C 3/0064* (2013.01); *A41C 3/02* (2013.01)

(58) Field of Classification Search
CPC ..... A41C 3/00; A41C 3/06; A41C 3/0028; A41C 3/0069
USPC ..... 450/1, 89, 86, 36, 54–58; 2/104, 105, 2/106, 114, 110, 109, 69, 67
See application file for complete search history.

(56) References Cited

U.S. PATENT DOCUMENTS 6,390,885 B1 * 5/2002 Brooks ..... A41C 3/0064 450/1
6,574,800 B1 * 6/2003 Leger ..... A41D 13/1245 2/114
2005/0010273 A1 * 1/2005 Walker ..... A61B 17/3415 607/105
2006/0085890 A1 * 4/2006 Beuk ..... A41D 13/1281 2/114
2006/0173427 A1 * 8/2006 Urbina ..... A41C 3/0064 604/327
2008/0282441 A1 * 11/2008 Green ..... A41D 13/1245 2/69

* cited by examiner

*Primary Examiner* — Gloria Hale
(74) *Attorney, Agent, or Firm* — Kaplan Breyer Schwarz & Ottesen, LLP

(57) ABSTRACT

A post-surgery bra includes an aperture appropriately sited to so that tubes from a boost-treatment device or drain implanted in a wearer of the bra protrude therethrough. The post-surgery bra includes a fixation element for immobilizing the tubes of the boost-treatment device that protrude through the aperture. In some embodiments, the post-surgery bra also includes a retaining ring, which is coupled to the bra below the breast cup nearest to the aperture and which is openable and closeable for engaging and securing a loop of material that extends from the collection bulb of the drain.

16 Claims, 2 Drawing Sheets

POST SURGERY BRASSIERE

STATEMENT OF RELATED CASES

This case claims priority to U.S. Pat. App. 62/140,827 filed Mar. 31, 2015, which is incorporated by reference herein.

FIELD OF THE INVENTION

The present invention relates to brassieres in general and, more particularly, to a brassiere for use by women during and immediately after accelerated partial breast irradiation and other treatment techniques.

BACKGROUND OF THE INVENTION

Early stage breast cancer is not an uncommon problem in the United States. It is estimated that there will be about 300,000 such cases in 2015. Since 1998, the Federal government has required that women are presented with all options for surgery and reconstruction of their affected breasts. This includes lumpectomy (i.e., removal of the cancerous mass and surrounding tissue) followed by radiation or mastectomy (i.e., removal of the entire breast) with or without reconstruction and possibly radiation therapy as well.

There are many options for treatment with lumpectomy or partial mastectomy followed by radiation treatment to the breast. In most cases in which radiation therapy is provided, a "boost" dose of radiation is delivered to the tumor bed in addition to a longer course of treatment for the entire breast or portion thereof. The boost can be performed in a variety of ways, such as delivery through a linear accelerator of photons or electron fields, radiation in the operating room, electromagnetic generation or radiation delivered by an after-loaded catheter/brachytherapy device.

With respect to the latter approach, the radiation is delivered, for example, via a group of flexible after-loading catheters that are placed in the breast (multi-catheter interstitial brachytherapy), a balloon that is connected to a catheter (balloon-based brachytherapy), modified forms of balloon-based therapy using a balloon catheter with multiple ports (e.g., one for insertion of the radiation source, a second for inflating the balloon with saline, and a third for drainage of seroma fluid or air), and other approaches. These devices will be collectively referenced as "boost-treatment devices."

Normally, patients are fitted with the boost-treatment devices in the operating room or physician's office, radiation dosimetry is thereafter planned, and then the patient is sent home for several days before beginning electromagnetic or radioactive after-loading.

During this time period, women cannot comfortably wear a conventional brassiere or conventional surgical bra because of the presence of the multiple catheters extending under the axilla (arm pit) region. This leads to pain—back pain as a consequence of the lack of support for the breasts, pain as a consequence of the heaviness of the breasts without support after surgery, and pain at the wound site due to the presence of the catheters—and an inability to wear clothes in public without embarrassment. The most common complications for patients include infection, seroma and hematoma in the tumor bed cavity, as well as rotation/movement of the boost-treatment device.

The latter complication—rotation or other movement of the boost-treatment device—can be quite serious, leading to failure of consistent dose delivery. In this situation, the boost-treatment device needs to be removed before the radiation course is completed or necrosis occurs. Movement of the catheter necessitates additional radiation planning and often results in delays in the course of treatment. Not only does this cost money and take an emotional toll on the patient, but there is risk to the patient of further progression of disease.

Existing post-surgical bras cannot address the problems presented by boost treatment devices. U.S. Pat. No. 5,429,593 to Matory and U.S. Pat. No. 6,390,885 to Brooks, which are representative of the art, disclose surgery recovery brassieres with drainage tube apertures and tab closures. The tab closures, which are oriented horizontally, are intended to close the aperture (Matory) or to reduce the size of the aperture to better secure the drainage tubes therein (Brooks) to further reduce the movement of the tubes. The use of the tab closure, horizontal or otherwise, will not prevent rotation of any tubes extending through the aperture.

SUMMARY OF THE INVENTION

The present invention provides a post-surgery brassiere for holding the tubes of a boost-treatment device securely against a patient's body in such a way as to prevent rotation, migration, or any movement thereof. The bra does not interfere with any surgical dressings or arm movement.

In accordance with the illustrative embodiment, the brassiere includes at least one side opening ("aperture") through which the catheters/tubes of the boost device extend. The aperture(s) are disposed in the side panel/back band of the brassiere.

The aperture is preferably a placket; the placket preferably extends through the base band of the brassiere. In some embodiments, particularly those in which the opening extends through the base band, the brassiere further includes a closure to fasten the base band. In some embodiments, the closure is a tab or strip of material, such as can be formed from hook-and-loop fastener (e.g., VELCRO®, etc.). In some embodiments, the tab is oriented in line with the base band, such that the tab has a substantially horizontal orientation when the brassiere is worn.

In accordance with embodiments of the invention, the brassiere also includes a fixation element for immobilizing the catheters/tubes of the boost-treatment devices that protrude from the aperture. As used in this disclosure, the term "immobilize" and inflected forms thereof means to prevent rotation, migration, or any movement of an immobilized item, such as catheters, tubes, etc.

In the illustrative embodiment, the fixation element is distinct from the closure that fastens/tightens the aperture. In some embodiments, fixation element is a tab or strip of material, such as can be formed from hook-and-loop fastener (e.g., VELCRO®, etc.). There is no per se requirement that the fixation element be distinct from the closure. However, to the extent that a single element is intended to function as both a closure and a fixation element, it is must be capable of immobilizing the catheters/tubes protruding from the aperture.

In the illustrative embodiment, the fixation element is situated a short distance from the aperture and is oriented, as appropriate, to receive and immobilize the catheters/tubes. In embodiments in which the fixation element is a tab or strip of material, the tab is preferably oriented substantially parallel to the placket; that is, in such embodiments, the tab has a more or less vertical orientation, substantially orthogonal to the base band of the brassiere.

The fixation element reduces the discomfort otherwise experienced by patients. It also provides the critically important benefit of ensuring that physicians and dosimetrists can plan the radiation dose from the measurements obtained at the time of surgery (for implantation of the boost treatment devices) with confidence that the geometry and patient tissue position will be maintained since the boost-treatment device is immobilized.

In some embodiments, the closure for the base band includes indices, etc., for marking the closure position. This affords the physician with the ability to document and reproduce the fit of the brassiere to the patient.

In some embodiments, the brassiere is also physically adapted to accommodate drains, such as a JP drain. The drains are surgically implanted near each operative site to drain serous lymphatic fluid as well as some blood that accumulates after the mastectomy or breast surgery. Such drains include about a meter of flexible tubing that transports fluid from the surgical site to a bulbous reservoir ("collection bulb"). A perforated collection tube lies under the skin; most of the tubing and the collection bulb are extracorporeal. The tubing can extend through the same aperture as the tubes from the boost-device or through another aperture located on the same side or the opposite side of the brassiere.

The physical adaption(s) for accommodating the JP drain include: (i) a fastener that is capable of opening and closing, and, optionally, (ii) a piece of material, etc., by which the fastener couples to the bra.

In the illustrative embodiment, the fastener is in the form of a retaining ring or "circlip" (a portmanteau of "circle" and "clip"), preferably made of plastic. Non-limiting examples of suitable retaining rings include a spiral ring, snap ring, and the like. In preferred embodiments, the retaining ring is coupled to and hangs from a loop of material (ribbon, etc.) that is attached to and extends below the base band of the brassiere.

A patient or caregiver opens the retaining ring to engage the loop of plastic (a feature of all JP drains) that is attached to the collection bulb, and is then closed. The use of the openable/closable retaining ring avoids having to use a safety pin, etc., to attach the JP drain to a (closed) loop of material, etc., on the bra, as in some prior-art designs.

Thus, the collection bulb is fully supported by the bra without the use of pouches or external fasteners. Furthermore, this arrangement ensures that the collection bulb hangs below the heart, as is required for best fluid drainage via gravity and suction.

Also, because the collection bulb is attached to the brassiere near its bottom edge, and because the drain tubing remains hidden underneath the patient's blouse, it is very unlikely that the drain tubing could snag on anything that would otherwise cause tension/tugging on the sutured skin at the drain tube insertion site. Furthermore, the collection bulb is not forced into an ill-fitting pocket, as in a number of prior-art post-surgery garments. As a consequence, pain and discomfort are minimized and accidental dislodgement of the tubing is prevented.

DETAILED DESCRIPTION

Figure 1:
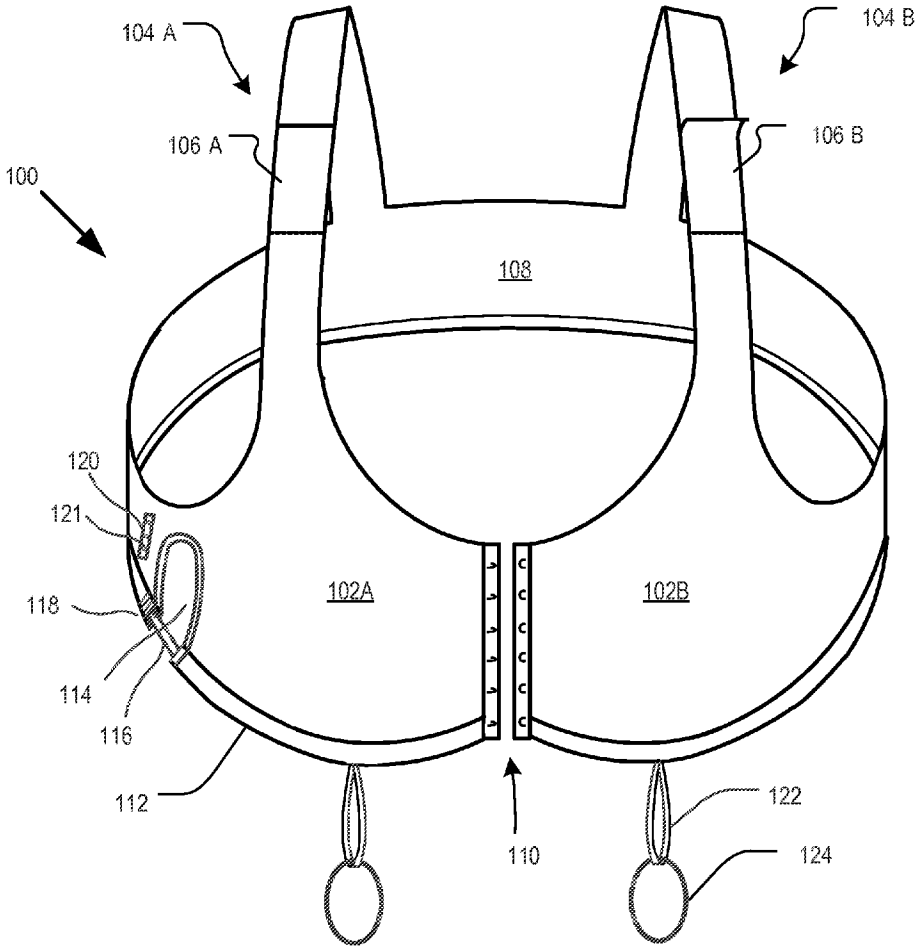
FIG. 1 depicts a front perspective view of a post-surgery brassiere in accordance with the illustrative embodiment of the present invention.

FIG. 1 depicts post-surgery brassiere 100. In the illustrative embodiment, bra 100 includes cups 102A and 102B, shoulder straps 104A and 104B, back band 108, and base band 112.

Cups 102A and 102B and back band 108 comprise a compressive fabric, such as, without limitation, Lycra® brand spandex fiber or Tencel® brand fiber. Using a compression-type material promotes healing and reduces the risk of seroma formation. In some embodiments, the compressive fabric includes an anti-stain treatment. In some further embodiments, the brassiere comprises a fabric liner that is resistant to serous and serosanguinous staining. In yet some additional embodiments, the brassiere comprises a removable fabric liner, which can be disposed of or washed.

Brassiere 100 is readily removable to provide for wound-site care and is capable of machine washing so that blood, bacteria, and fluids draining from the wound can be removed from the garment. This reduces the risk of bacteria harboring in the surgical garment. It also reduces the need for excess gauze and padding because the bra can be readily removed and washed.

Such removability is facilitated in brassiere 100 by one or more release points; the illustrative embodiment has three. One release point is medial closure 110, which is disposed between cups 102A and 102B. In the illustrative embodiment, medial closure 110 is a hook-and-eye fastener; in some other embodiments, other fastening arrangements (e.g., hook-and-loop, etc.) may suitably be used. The other two release points are superior closures 106A and 106B, which are situated along respective shoulder straps 104A and 104B. In the illustrative embodiment, superior closures 106A and 106B comprise paired strips of hook-and-loop fastener, such as VELCRO® brand, available from Velcro Co. of Manchester, N.H.

In some alternative embodiments, superior closures 106A and 106B can be situated between each cup 102A and 102B and the respective shoulder strap 104A and 104B.

Base band 112 comprises an elastic material that is attached to the bottom edge of the cups 102A and 102B and back band 108. By virtue of its elasticity, band 118 ensures that the bottom of the bra remains tight to the body.

Aperture 114 is disposed in back band 108; it is sited so that when the brassiere is in use, the aperture aligns with the side of the wearer underneath the axilla (i.e., arm pit). In the illustrative embodiment, aperture 114 is a placket, which is arranged to open through base band 112. The aperture is closed by closure 116, which in the illustrative embodiment is implemented as a strip of hook-and-loop fastener that couples to piece of hook-and-loop fastener disposed on base band 118. Alternatively, base band 112 or a portion thereof can be formed of a "hook-compatible fabric" (i.e., VELCRO® receptive). In other words, closure 116, when implemented as hook-and-loop fastener, will simply "stick" to the fabric. Such fabric is commercially available from Darlington Fabrics of Westerly, R.I., and others. In some other embodiments, other types of closure mechanisms known to those skilled in the art can suitably be used.

Although brassiere 100 depicts a single aperture 114, in some other embodiments, a second aperture, typically in the form of a placket, is disposed on the opposite side of the brassiere. The second aperture is situated so that when the bra is worn, the second aperture aligns generally with a wearer's other axilla.

Aperture 114 enables the tubes from a boost-treatment device to pass through the brassiere. To the extent it is present, the flexible tubing of a drain, such as a JP drain, can pass through aperture 114 as well. The inventor recognized that using a placket, as opposed a hole through the side band, enables a user to put on or take off the brassiere without removing the drain's collection bulb. Also, if a discrete hole/opening is sized to permit passage of a collection bulb for a specific type of drain, it might be undersized to permit the passage of other bulbs from other drains.

The boost-treatment device tubes and JP drain tube extending from aperture 114 raise different concerns. As previously indicated, the boost-treatment tubes must be immobilized to prevent rotation or any movement thereof. The collection bulb and tubing of the JP drain, on the other hand, must simply be supported below the heart in as unobtrusive a manner as possible.

In accordance with embodiments of the invention, to address the boost-treatment device tubes, the brassiere includes fixation element 120 for immobilizing the catheters/tubes of the boost-treatment devices. In the illustrative embodiment, fixation element 120 is situated a short distance (e.g., typically ½ to 1½ inches) from aperture 114 and is oriented, as appropriate, to receive and fully immobilize the catheters/tubes.

In the illustrative embodiment, fixation element 120 comprises a first strip of material that is attached (e.g., sewn, etc.) to the back band. The first strip of material includes the female half of each of several (three in the illustrative embodiment) snaps 121. The fixation element 120 also includes a second strip of material having the male half of each of several snaps 121. The first and second strip of material can be snapped together.

The distance between adjacent snaps 121 is quite small, such that the tubes of boost-treatment devices, once positioned between adjacent snaps, are tightly compressed against one another so that they are effectively immobilized. In some other embodiments, the female and male portions of snaps can be replaced, for example, with several pieces of hook-and-loop fastener.

In the illustrative embodiment, fixation device 120 is oriented substantially parallel to aperture 114. That is, in such embodiments, fixation device 120 has a generally vertical orientation, such that it is substantially orthogonal to base band 112 of the brassiere. This orientation places the tubes of boost-treatment devices exiting protruding from aperture 114 under the least amount of stress/tension (i.e., from bending), making it relatively easier to immobilize the tubes.

To support the extracorporeal portions of a JP drain, in the illustrative embodiment, brassiere 100 includes two loops 122 of material, such as ribbon, etc., one of which hangs from base band 112 below each cup 102A and 102B. One retaining ring 124 couples from each loop 122. In the illustrative embodiment, retaining rings 124 comprises plastic. The retaining rings can be opened and closed to support the collection bulb and a drain and the associated tubing.

Markings 118, which in the illustrative embodiment are a series of parallel vertical lines printed or otherwise appearing on base band 112, serve as a scale for repeated, consistent positioning of closure 116.

Figure 2:
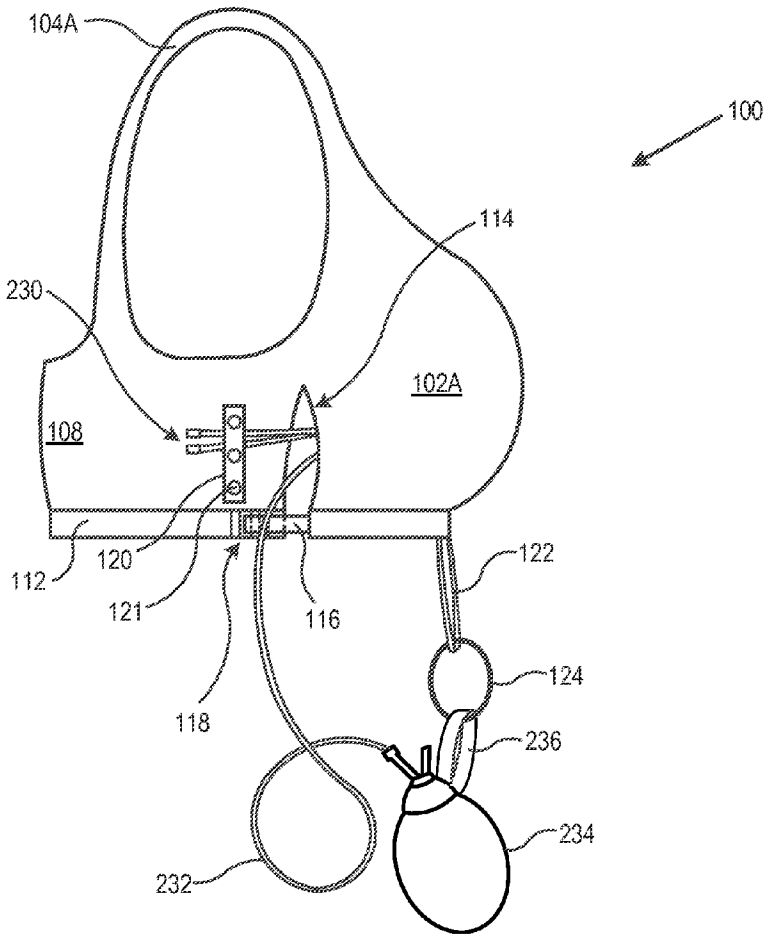
FIG. 2 depicts a side view of the brassiere of FIG. 1.

FIG. 2 depicts post-surgery brassiere 100 in use (patient's body is not depicted for clarity). Two boost-treatment-device tubes 230 and tube 232 of a JP drain are shown protruding from aperture 114. Those skilled in the art will appreciate that a boost-treatment device and a JP drain would typically not be used in a patient at the same time; they are shown together in FIG. 2 for convenience.

As depicted in FIG. 2, fixation element 120 immobilizes tubes 230 of a boost-treatment device against back band 108 of brassiere 100. Drain tube 232 couples to collection bulb 234 of a JP drain. The collection bulb collects excess lymphatic fluid that is withdrawn from the body via tube 230. Retaining ring 124 is coupled to loop 236 of collection bulb 234. As previously discussed, to couple retaining ring 124 to loop 236, the ring is opened, the loop 236 is positioned on the opened ring, and then the ring is closed. As appropriate, fixation element 120 can be used to provide additional support to tube 232 of the JP drain.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A post-surgery brassiere for use in conjunction with a patient having an implanted drain or an implanted boost-treatment device having one or more tubes extending out of the patient in a substantially horizontal orientation, the brassiere comprising:

two breast cups;

a back band that couples to the two breast cups;

a first aperture disposed at a first location in the back band, wherein, when the brassiere is in use on the patient, the first location is disposed below a first axilla of the patient; and a first fixation element, wherein the first fixation element is disposed dorsal to the first aperture and spaced apart therefrom, wherein the first fixation element is physically configured and oriented so that if the one or more tubes of the implanted boost-treatment device extend out of the patient and through the first aperture of the brassiere in the substantially horizontal orientation, the first fixation element is capable of receiving and immobilizing the tubes so as to maintain same in the substantially horizontal orientation.

2. The post-surgery brassiere of claim 1 further comprising:

a base band disposed below the two breast cups and the back band, wherein the first aperture is a placket that extends through the base band, resulting in a break therein; and a closure, wherein the closure is in-line with the base band and is disposed to span the break in the base band to close the break and the first aperture.

3. The post-surgery brassiere of claim 1 further comprising a first retaining ring, wherein the first retaining ring is disposed below the breast cup nearest to the first aperture, wherein the first retaining ring is openable and closeable so that if a collection bulb and tube of the implanted drain extend through the first aperture, the first retaining ring is capable of directly engaging and securing itself to a first loop of material that is associated with the collection bulb.

4. The post-surgery brassiere of claim 3 wherein the first retaining ring is coupled to the base band.

5. The post-surgery brassiere of claim 4 and further comprising a second loop of material that attaches to the base band, wherein the first retaining ring is coupled to the base band via the second loop of material.

6. The post-surgery brassiere of claim 1 wherein the first fixation element is configured so that when the tubes are immobilized, free ends of the tubes are directed towards a back of the brassiere.

7. The post-surgery brassiere of claim 2 wherein the first fixation element is configured so that when immobilized, the tubes are substantially parallel to the base band.

8. The post-surgery brassiere of claim 1 wherein the first fixation element comprises a plurality of spaced apart snaps, wherein the tubes from the boost-treatment device are positioned between adjacent snaps for immobilization.

9. The post-surgery brassiere of claim 1 further comprising a second aperture disposed at a second location in the back band, wherein, when the brassiere is in use, the second location is disposed below a second axilla of the patient.

10. The post-surgery brassiere of claim 9 further comprising a second fixation element, wherein the second fixation element is physically configured and oriented so that if the one or more tubes of the implanted boost-treatment device extend out of the patient and pass through the second aperture of the brassiere in the substantially horizontal orientation, the second fixation element is capable of receiving and immobilizing the tubes so as to maintain same in the substantially horizontal orientation.

11. The post-surgery brassiere of claim 10 further comprising:

a first retaining ring, wherein the first retaining ring is disposed below the breast cup nearest to the first aperture, wherein the first retaining ring is openable and closeable so that if a collection bulb and tube of the drain pass through the first aperture, the first retaining ring is capable of directly engaging and securing a loop of material that is coupled to the collection bulb;

a second retaining ring, wherein the second retaining ring is disposed below the breast cup nearest to the second aperture, wherein the second retaining ring is openable and closeable so that if the collection bulb and the tube of the drain pass through the second aperture, the second retaining ring is capable of directly engaging and securing the loop of material.

12. A post-surgery brassiere for use in conjunction with a patient having at least one of an implanted drain or an implanted boost-treatment device having one or more tubes extending out of the patient in a substantially horizontal orientation, the brassiere comprising:

two breast cups;

a back band that couples to the two breast cups;

a base band disposed beneath the two breast cups and the back band;

a first placket disposed at a first location in the back band, the placket extending through the base band, wherein, when the brassiere is in use by the patient, the first location is disposed below an axilla of the patient; and a first fixation element, wherein the first fixation element has a configuration and orientation that enables same to receive and immobilize the one or more tubes of the implanted boost-treatment device in a substantially horizontal orientation when the tubes extend from the patient and through the first placket in the substantially horizontal orientation.

13. The post-surgery brassiere of claim 12 further comprising a first retaining ring, wherein the first retaining ring is disposed below the breast cup nearest to the first placket, wherein the first retaining ring is openable and closeable to directly engage and secure a loop of material that couples to a collection bulb of the implanted drain.

14. The post-surgery brassiere of claim 13 and further comprising a loop of material that attaches to the base band, wherein the first retaining ring is coupled to the base band via the loop of material.

15. A post-surgery brassiere for use in conjunction with a patient having at least one of an implanted drain or an implanted boost-treatment device having one or more tubes extending out of the patient in a substantially horizontal orientation, the brassiere comprising:

a first placket disposed at a first location in the brassiere, wherein, when the brassiere is in use by the patient, the first location is disposed below an axilla of the patient; and a first fixation element having a first configuration and a first orientation, wherein, when the one or more tubes of the implanted boost-treatment device extend from the patient and through the first placket in a substantially horizontal orientation, the first configuration and first orientation enable the first fixation element to receive and immobilize the tubes such that the tubes are maintained in substantially the same horizontal orientation in which they extend from the patient and through the first placket.

16. The post-surgery brassiere of claim 15 further comprising a first retaining ring, wherein the first retaining ring is coupled to brassiere and is openable and closeable to directly engage and secure a loop of material that is coupled to a collection bulb of the implanted drain.

* * * * *